US005313376A

United States Patent [19]

McIntosh

[11] Patent Number: 5,313,376

[45] Date of Patent: May 17, 1994

[54] MULTIPURPOSE KNIFE/LIGHT

[76] Inventor: Kirk W. McIntosh, P.O. Box 370678, San Diego, Calif. 92137

[21] Appl. No.: 8,400

[22] Filed: Jan. 25, 1993

Related U.S. Application Data

[63] Continuation of Ser. No. 271,591, Nov. 14, 1988, abandoned.

[51] Int. Cl.[5] ..... F21V 33/00

[52] U.S. Cl. ..... 362/119; 362/157; 362/202; 7/119

[58] Field of Search ..... 362/119, 157, 253, 190, 362/202; 7/118, 119

[56] References Cited

U.S. PATENT DOCUMENTS

| | | | |
|---|---|---|---|
| 1,472,826 | 11/1923 | Champlin | 7/119 |
| 3,370,163 | 2/1968 | Brill | 362/119 |
| 4,669,186 | 6/1987 | Liu | 362/119 |
| 4,751,621 | 6/1988 | Jenkins | 362/119 |
| 4,783,867 | 1/1988 | Tsao | 7/119 |
| 4,918,775 | 4/1990 | Leu | 362/119 |
| 4,944,392 | 7/1990 | Hull et al. | 7/118 |

*Primary Examiner*—Richard R. Cole
*Attorney, Agent, or Firm*—Nydegger & Associates

[57] ABSTRACT

Disclosed herein is an illuminated multifunctional pocket knife/light. The casing or handle has at least one hollow channel within which is disposed at least one light bulb, and one power source out of contact with one another. Activation of switch completes electrical circuit thus activating the light source/s. Alternative embodiments illustrate different positions for various switch components. The handle can be partially or entirely constructed from a light transmissive or optical wave dispersing material which guides light through the handle and assists in illuminating the blade/implement and its surrounding work surface. The casing supports the desired tool/implement in the field of light. The casing houses at least one chamber in which one or more blades/implements are connected. Blades/implements are fixed in permanent position or folding/collapsible for the purpose of storing and protecting the implements until use. Alternative embodiments further illustrate that blade/tool fixtures may be either locking or non locking. Alternative embodiments also illustrate that flashlight, compass, whistle, survival capsules and weighing scale are detachable or permanent components of the casing. The compass module is a cap housing a light source and a liquid or dry chamber in which a translucent dial is seated.

13 Claims, 5 Drawing Sheets

MULTIPURPOSE KNIFE/LIGHT

This is a continuation of co-pending application Ser. No. 07/271,591 filed on Nov. 14, 1988, now abandoned.

BACKGROUND OF THE INVENTION

1. Field of the Invention

This invention relates to an electrically illuminated pocket knife/light.

2. Prior Art

Knives combined with flashlights assemblies are known in prior art. U.S. Pat. No. 4,751,621 which was issued to Edward Jenkins on Jun. 14th, 1988 discloses a knife handle containing a light positioned in one end directly opposite the fixed blade. Another reference incorporating a similar fixed blade configuration is that of R. D. Brown issued on Dec. 13, 1932 as U.S. Pat. No. 1,890,841. Here again Brown uses a configuration that does not allow for the light pattern created from the bulb to illuminate the blade and cutting surface. U.S. Pat. No. 2,588,162 granted to P. F. Riggio for his "Magazine tool handle" features a tubular casing that serves as a housing for various detachable implements. The light source is positioned in the opposite end that of the tool/implements when they are attached for use. U.S. Pat. No. 3,370,163 granted to D. Brill on Feb. 20th, 1968, discloses a molded pliable member comprised of a pair of slots directed therethrough one for holding a fixed implement and one parallel channel housing a flashlight assembly. Brill's apparatus shines light on the tool and work place however the device provides no means for storing or protecting the implement and it is intended to be detached from the implement after use. U.S. Pat. No. 4,283,757 granted to Nalbandian et al of Aug. 11th, 1981 features an illuminated screw driver or hand tool. The tool is positioned in the pattern of light however the handle is not designed to store the implements. U.S. Pat. No. 1,515,751 granted to L. E. Polhemus on Nov. 18th, 1924 shows a combined folding knife and pistol. U.S. Pat. No. 2,822,615 issued to C. I. Durst and Hazel Thompson on Feb. 11th, 1958 shows a light attachment accessory for use with an electric drill.

The problem with the afore cited references is that none of them combine a light source that shines on the implement and work area with a quickly accessible storage compartment for easy quick extension of desired implement.

The pocket knife/light is unique in that it combines the implement storing capacity of standard pocket knife technology and the illumination capacity of standard flashlight technology to achieve a compact casing that can disperse light on the desired implements and work area as well as store various blade/implements.

SUMMARY OF THE INVENTION

It is the primary object of the present invention to provide a multifunctional utility knife that incorporates a variety of functions in a small compact casing.

It is another object of the present invention to provide a strong field of illumination on the blade/tool and work area.

It is a further object of the present invention to provide a casing which has a means of storing and protecting knife/implements.

It is a further object of the present invention to provide a knife casing that employs a means of housing either permanent or detachable components as listed A flashlight body and/or focusable reflector lens assembly and/or a light bulb.

A compass.

A temperature gage.

A whistle.

An ice spike.

One or more capsules for the purpose of storing various survival paraphernalia.

A weighing scale.

A phillips head/regular/alan, fingernail key ring.

NON DETACHABLE FUNCTIONS

Signal mirror

Ruler

These and other objects of the present invention, which may become obvious to those skilled in the art through the hereinafter detailed description of the invention are achieved by a compact knife casing comprising of:

At least one chamber which houses the light assembly, at least one chamber that houses the blade/implements, and at least one chamber that houses any of the aforementioned components with the exception of the phillips fingernail file key ring.

The light chamber is generally cylindrical and houses at least one or more miniature dry cell batteries disposed in a series arrangement, a miniature lamp and/or lamp housing assembly comprises of a non electrical conductive material, generally two O-rings encircling the housing and resting in molded depressions for the purpose of seating the housing in the chamber and sealing out molster, and an electrical conductor for making a contact and completing a circuit.

Access to the chamber containing the flashlight assembly can be achieved by means of removing front lens housing and/or lamp housing thus exposing battery/s for removal. Other means for accessing the light chamber can be achieved by removal of rear cap. Light chamber may be open on both ends or closed on one of the ends. Alternative embodiments disclose at least one longitudinal receptical being open at both ends or closed at one end in which a self contained flashlight component may be inserted and secured into position. The light chamber may be opened on both ends for the purpose of securing one or more light sources, a self contained flashlight having a light source on each end, or a module herein understood to contain independently or in any combination a compass, a temperature gage, a whistle or a survival chamber. Self contained flashlight body may also contain afore mentioned module and it's individual component combinations.

The casing is comprised of at least one blade/implement storing chamber generally being of a rectangular or slotted nature and having one or more openings. The slot/cavity is generally comprised of two openings being open at both ends or closed at one of the ends.

The entire casing may be comprised of one molded or cast piece or may be split along its longitudinal axis thereby making to halves or in knife terminology "boisters". The boisters may be connected by various means to include all pin or shaft combinations. Attachment by means of alan screws achieves a casing that can readily be assembled or disassembled. Alternative embodiments illustrate boisters that can be recessed or contain a least one space but generally two circular concentric depressions one in each bolster half, for the housing of a button activated locking mechanism.

The implement channel will house a standard lock knife mechanism comprised of a spring bar or rocker, secured with a single pin in the center which enables the rocker to execute a pivot motion. In the back of the casing is mounted a spring pin which applies pressure to the under side of the of the rocker. The rocker may extend out through an opening generally in the back of the casing. The opening is herein refered to as a "rocker window" through which the end or protrusion of the rocker extends out of the casing to provide a surface which can be activated by depression with thumb or finger. This engages a lever action which releases the blades or locks them into position by means of a notch and radius configuration located on the connected end of the implement. The blades may share a common rocker or have individual rockers for each individual blades. Non locking spring bar may substitute the locking rocker bar for a blade assembly that does not employ locking means. A combination of locking and non locking configuration may inhabit the same implement channel. All blades may be extended and locked at the same time. Blades/implements may also be in a permanently fixed position in the casing.

The implement channel may be fitted with a "liner" generally of a rectangular shape or a matching shape of the implement channel. The liner serves as separate assembly housing for speeding factory line production, as well as provide a surface for the implements that will not be easily worn through continual abrasion by extending and closing the implement/s. All of the locking mechanisms and/or implements may be assembled into the liner housing, then the liner may be secured into the implement channel of the casing.

The liner and/or casing may have one or more scalloped recess or curvatures on each bottom side. These curvatures align with fingernail grooves on the blades. When the blades/implements are in closed or collapsed position they can be quickly be extended by inserting fingernail into grooves and pivoting the implement outward.

A separate component herein refered to as a phillips head/file key ring may be inserted into desired curvature and used as a screwdriver. The key ring is comprised of one and one half concentric circles connected and generally comprised of one and the same continuous wire. The file or flatted portion intersects the underlying circle and ends in a phillips head tip that slightly protrudes past the underlying ring. The other end of the wire terminates in either a flat regular screwdriver tip with a hole in it for means of connecting, or loop comprised of a alan wrench or polygonal shaped molded into the entire wire or wire end. The concentric rings comprising the key chain can be separated by force to straddle both sides of the spacer plate and fit snugly into desired curvature thus creating an erect phillips/regular shaft that can be torqued with the knife casing serving as a handle.

Generally three pins or bushings hold the entire knife/light together. One in the front, securing one or more sandwich/spacer plates and/or the implements. One securing the rocker through the center or preferred pivot point. One securing the rear end portion of the spacer/s which divides the individual implements and aids the movement and protection of the implements.

Alternative embodiments illustrate at least one longitudinal chamber generally cylindrical being open at one or both ends and having means for securing a cap with O-ring. The chamber is herein refered to as a survival chamber in which survival paraphernalia such as matches and fish hooks are stored. The chamber is also functional as a receptical in which a removable component herein refered to as a survival capsule may be secured or removed from main casing.

The chamber is also functional as a weighing scale either by means of detachable component in casing comprising of a miniature scale or by chamber in main knife body having a longitudinal slit that opens inner chamber for viewing marker point on plunger connected at one end by center shaft and locking nut.

The longitudinal chamber is further functional as an implement housing compartment. The chamber may be threaded on one or more openings. An ice spike being threaded on one end and tapered to a point on the other can be secured by means of aforementioned threads for use and thusly inverted into chamber for concealment. Threaded end of spike has knurled or indented surface on end for applying torque when securing spike or closing chamber.

DESCRIPTION OF PREFERRED EMBODIMENT

Figure 1:
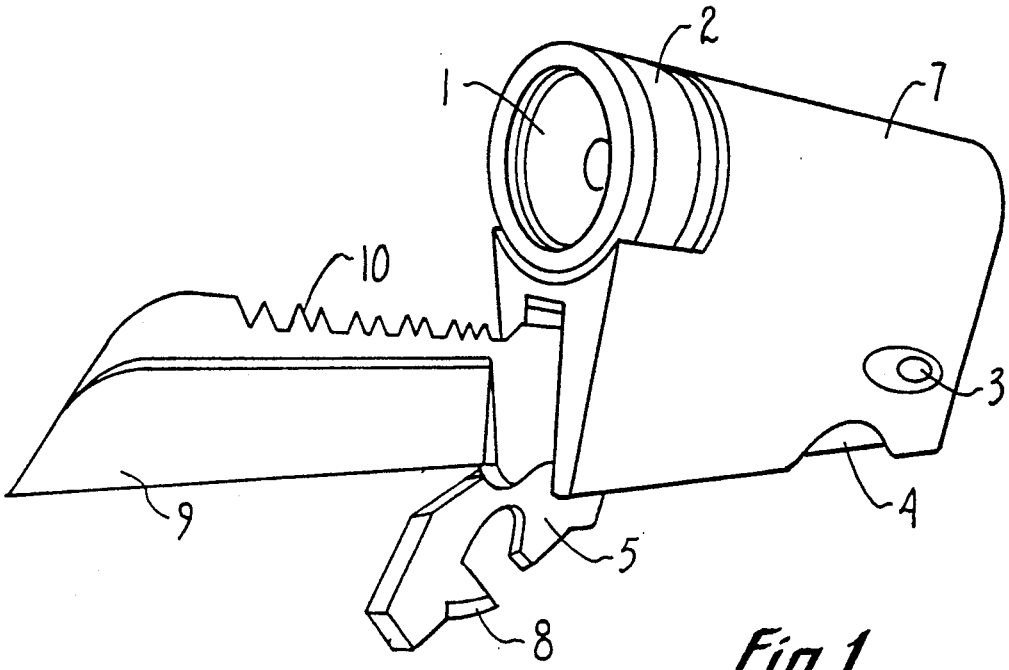
FIG. 1 is a three dimensional drawing embodying a preferred form of the present invention.
Figure 2:
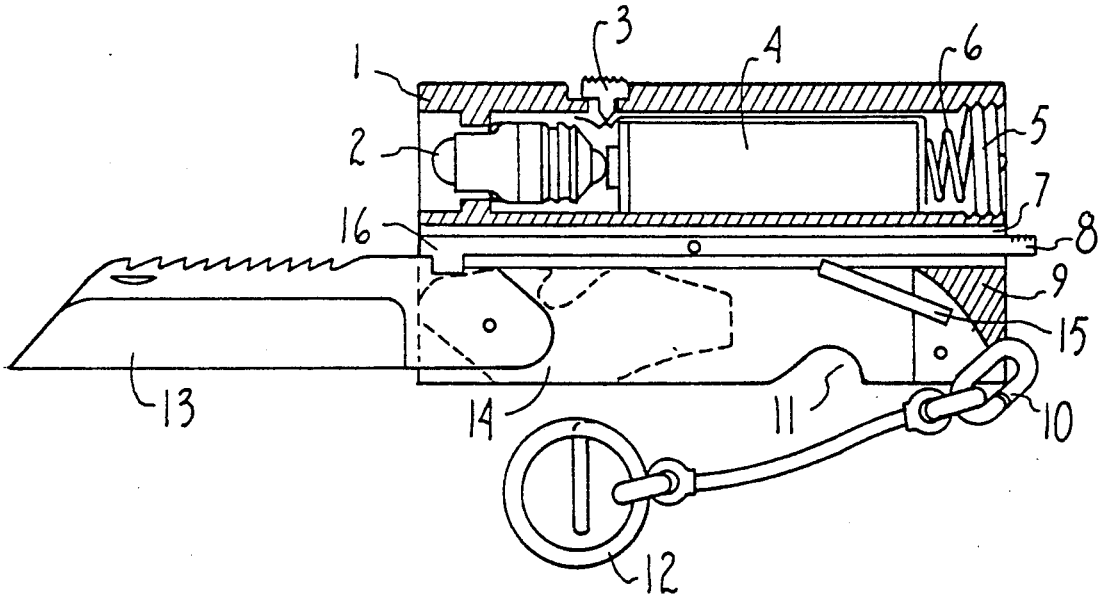
FIG. 2 is a longitudinal section view of the knife/-light casing.
Figure 3:
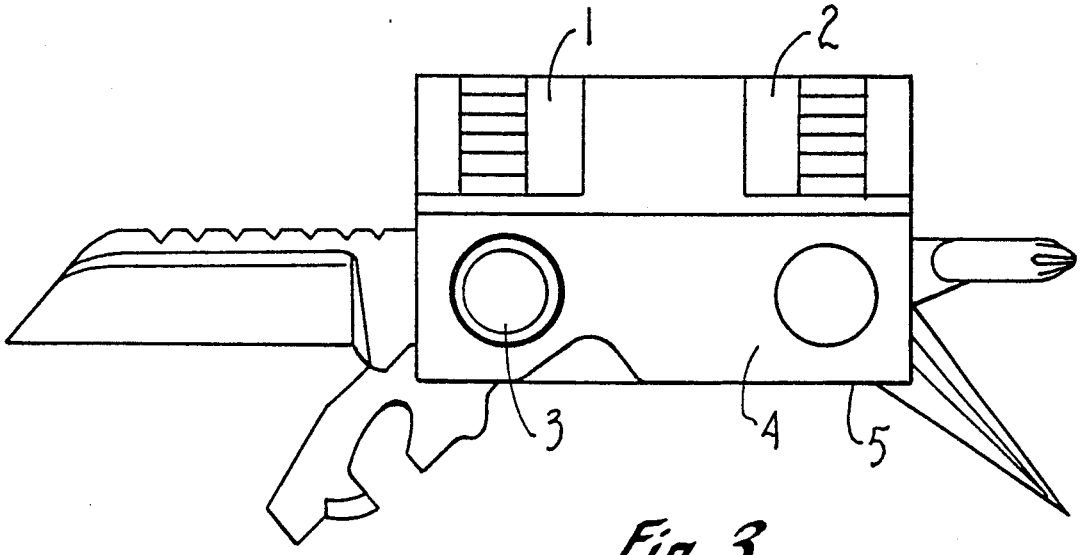
FIG. 3 is a longitudinal view of an alternative embodiment illustrating two light sources and circular depressions for housing locking mechanisms.
Figure 4:
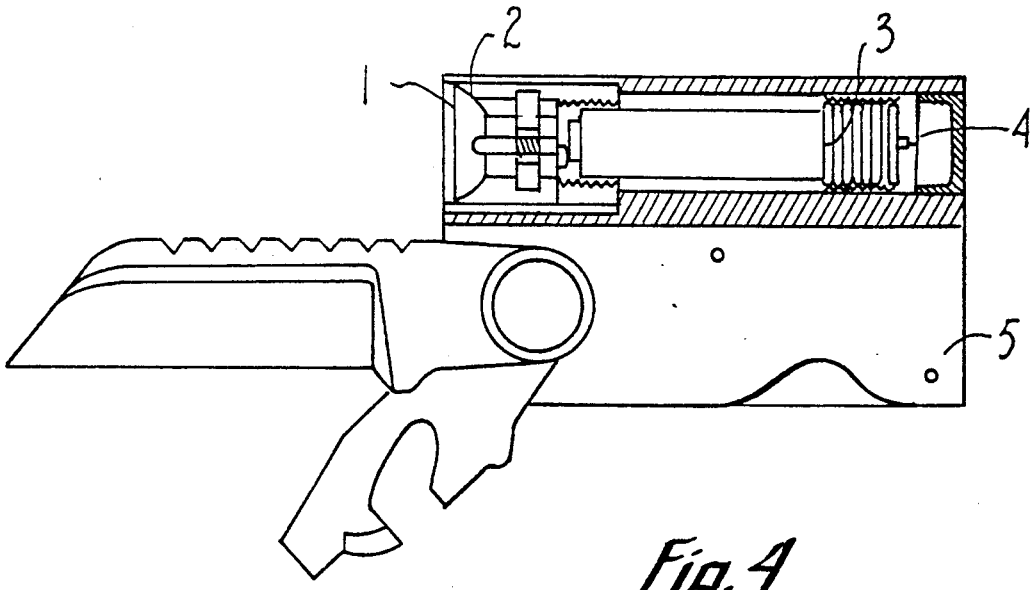
FIG. 4 is a longitudinal sectional view of knife/light casing incorporating flashlight, compass, and blade/implement locking assemblies.
Figure 5:
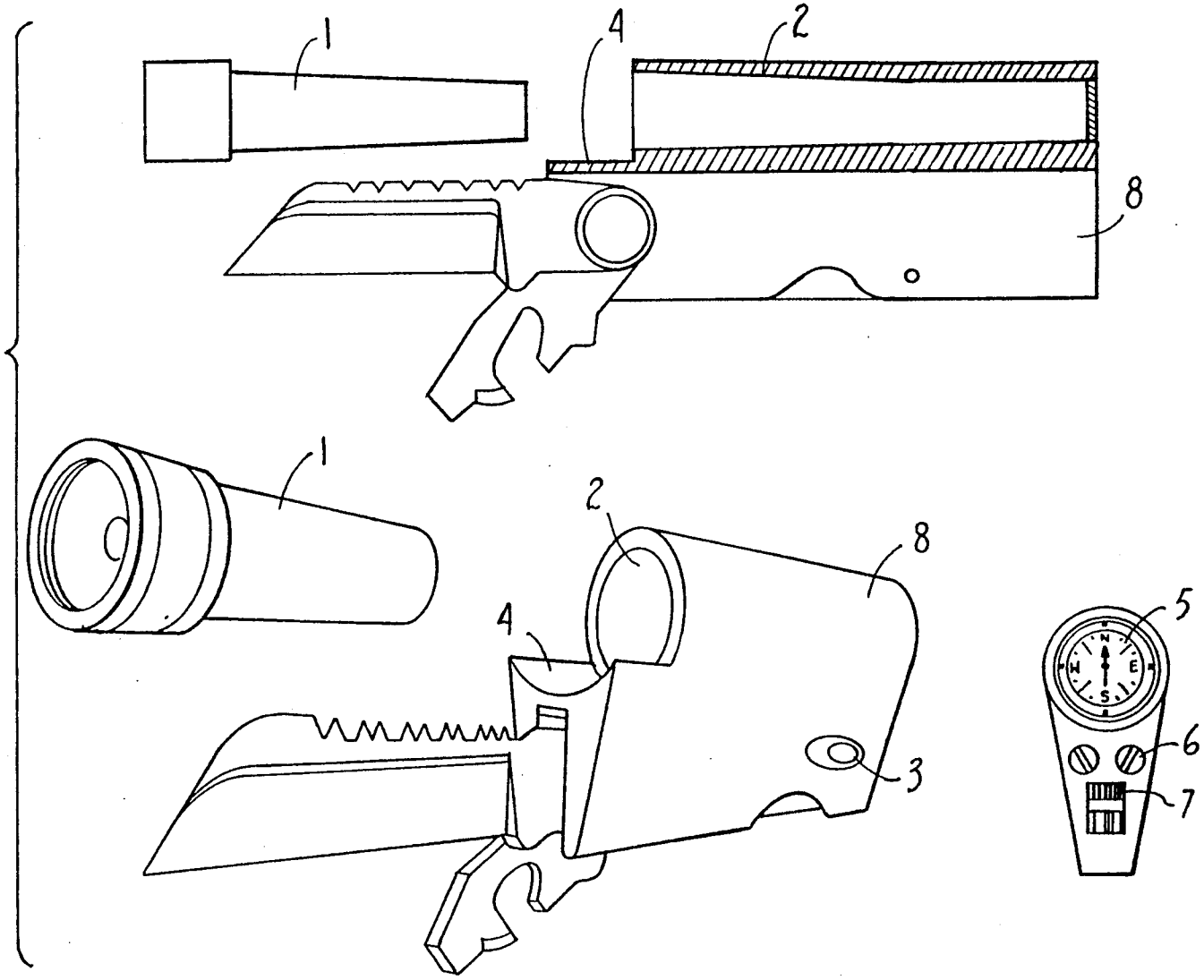
FIG. 5 is a three dimensional drawing illustrating detachable flashlight component, and its attaching receptical, and back of knife casing illustrating compass module above caped chambers, and rocker protrusion in rocker window.
Figure 6:
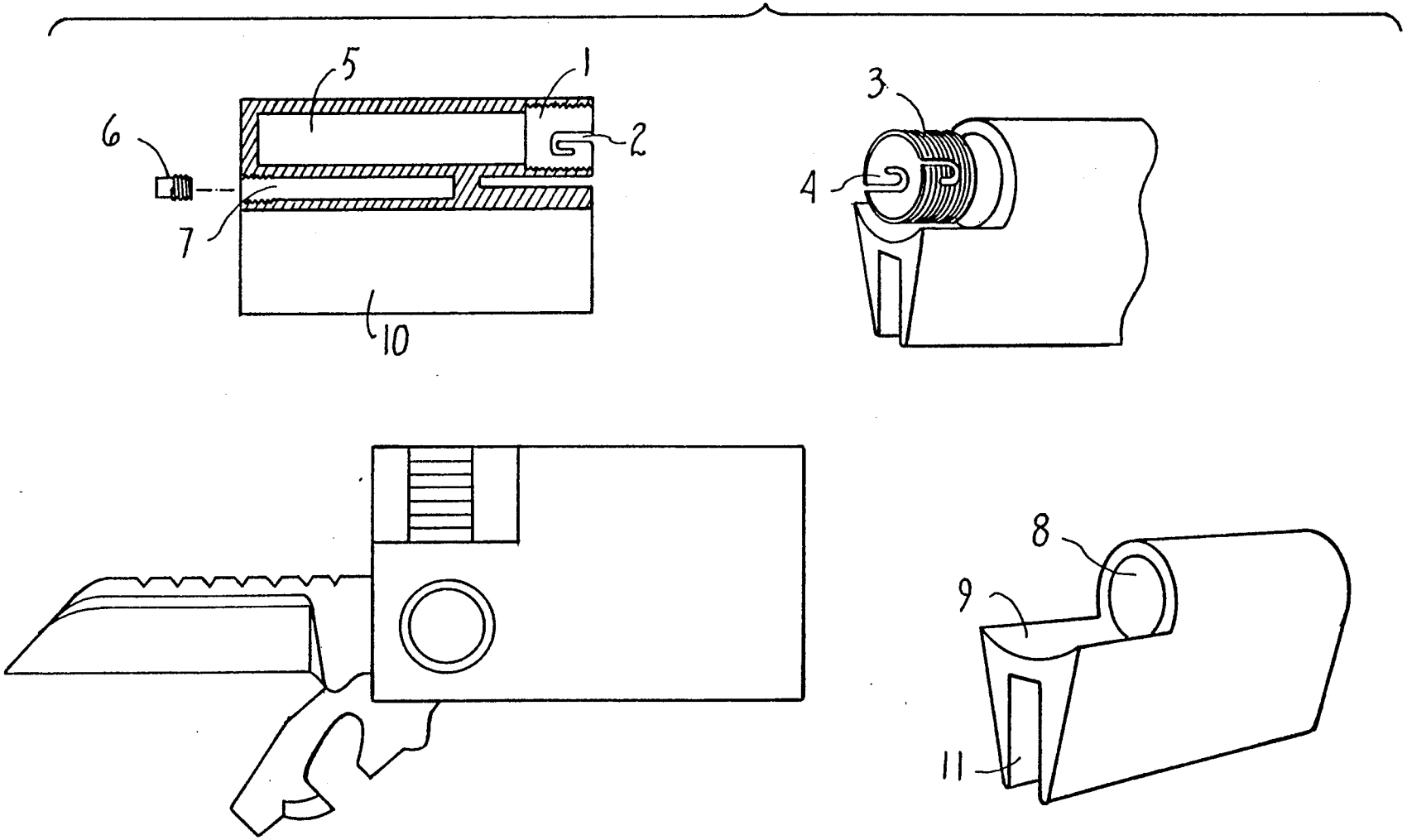
FIG. 6 is a combination of renderings illustrating a longitudinal cross section of knife casing having threaded protrusion and inner storage chamber, a three dimensional drawing of the front end of the same casing showing protrusion suspended over scalloped recession, a longitudinal cosmetic view of knife casing, and a three dimensional view of casing illustrating a knife casing having a receptical without a protrusion and scalloped recession.
Figure 7:
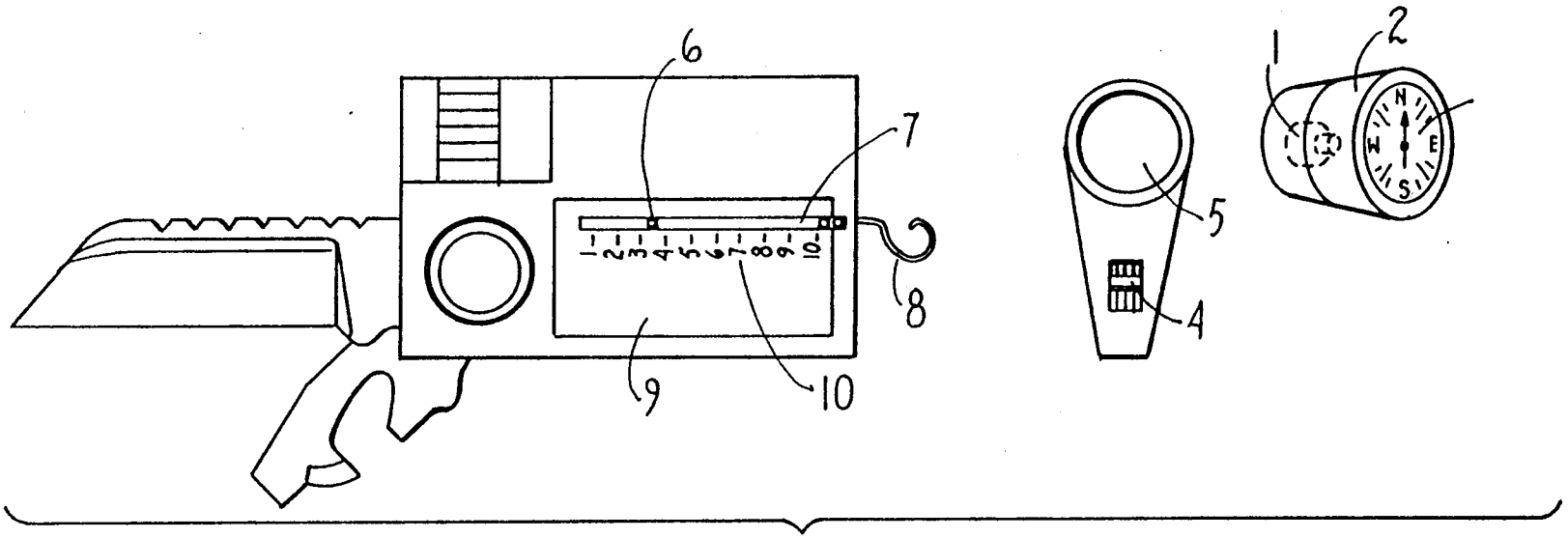
FIG. 7 is a longitudinal exterior view of knife casing illustrating a weighing scale, a back or end view of a casing, and a three dimensional view of a compass module component.
Figure 8:
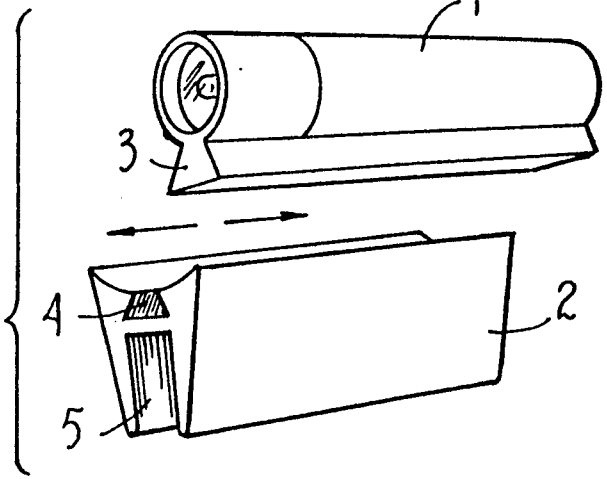
FIG. 8 is a three dimensional view of a detachable or attachable flashlight body illustrating track locking means.

Referring to FIG. 1, the knife casing 7 is generally cylindrical at the top, tapering inward towards the bottom of the casing. The light chamber 2 of FIG. 5, 8 of FIG. 6, 5 of FIG. 7, is generally a cylindrical receptical having a length to contain a flashlight assembly or self contained flashlight component. Casing and different chambers may be made of different lengths to receive desired number of batteries from one to ten or more. Flashlight body lengths may also vary shorter or longer. The lens cap housing 2 of FIG. 1,1 and 2 of FIG. 3, is generally of a cylindrical nature having one or more lenses and a parabolic reflector, and capable of being rotated to activate the light source/s 1 of FIG. 1, 1 of FIG. 7, in separate module components. The exterior of cap/s 2 of FIG. 1, 2 of FIG. 7, is usually scribed or molded with a knurled pattern. The cap is generally threaded for rotation on threaded/slotted casing protrusion 1 and 3 of FIG. 6. The blade/tool implements 9 and 5 of FIG. 1, 13 and 14 of FIG. 2, are generally connected to casing by a front center pin and are capable of being rotated out of casing opening 11 of FIG. 6,5 of FIG. 8, 5 of FIG. 3. Self contained flashlight embodiments 1 of FIG. 5 and 1 of FIG. 8, are generally cylindrical or tubular casings differing in lengths and capable of being detached or attached to main knife casing body 2 of FIG. 8 and 8 of FIG. 5. Survival chamber 7 of FIG. 6 is a generally tubular shaped longitudinal chamber capable of being closed or open by means of a cap and O-ring assembly 6 of FIG. 6, and 6 of FIG. 5. Rocker window 7 of FIG. 5, and 7 of FIG. 2, is a port opening generally of a square or rectangular shape from which a rocker or lock bar end 8 of FIG. 2 may protrude to provide a depression surface. Depression of rocker/-lock bar end, disengages or engages notched blade locking means through pivot motion. Compass module 5 of FIG. 5, is a detachable component housing one or more light sources 1 of FIG. 7, capable of being activated by a number of switching means to include rotation or depression into chamber 5 of FIG. 7, or 2 of FIG. 5, and protrusion opening 3 of FIG. 6. Alternative embodiments for non detachable flashlight assemblies are comprised of a casing 1 of FIG. 2, housing a series arrangement, generally comprised of a lamp 2 of FIG. 2, 1 of FIG. 1, or a lamp housing 2 of FIG. 4 being secured into chamber, at least one dry cell battery source 4 of FIG. 2, a spring or tension causing contact strip 6 of FIG. 2, and in some embodiments, a cap 5 of FIG. 2. Lens cap housing 1 of FIG. 1, 1 and 2 of FIG. 3, is generally a cylindrical body capable of being rotated in a suspended position over scalloped recession 9 of FIG. 6, and 4 of FIG. 5. Button/depression activated locking mechanism 3 of FIG. 3, is a locking assembly capable of being housed into circular recession of knife casing 4 of FIG. 3. Longitudinal chamber 7 of FIG. 7, is a generally rectangular or cylindrical chamber housing a weighing scale assembly, comprised of a spring/marker shaft 6 of FIG. 7 assembly.

Herein has been described a unique multifunctional utility knife/flashlight encompassing a variety of functions capable of illuminating the desired implement and storing different blade/implements. It is considerably smaller and compact in size than most fixed/permanent blade knives.

While the various embodiments have been described with reference to the FIGS. 1–8, the alternative embodiments are not to be interpreted as limitations upon the present invention. Many changes and modifications may be made by one skilled in the art to the various embodiments disclosed herein without deviating from the theme and scope of the present invention.

I claim:

1. A multipurpose knife for cutting, said knife comprising:

a handle;

means for cutting attached to said handle;

a flashlight having a substantially cylindrical body portion, said flashlight being attachable to said handle to illuminate said cutting means, said flashlight being operable when detached from said handle, said flashlight being attached to said handle by said body portion being inserted into a substantially cylindrical recess formed in said handle, said recess being sized to internally receive said flashlight and being positioned to allow said flashlight to illuminate said cutting means during attachment of said flashlight to said handle; and means for retaining said illuminating means in said recess wherein said retaining means is a narrowing in the substantially cylindrical recess to frictionally grip said body potion of said flash light during attachment of flashlight to said handle thereby retaining said flashlight in said handle recess.

2. The knife as recited in claim 1 wherein said cutting means is a knife blade.

3. The knife as recited in claim 1 further comprising a detachable compass.

4. The knife as recited in claim 1 further comprising a weighing scale.

5. The knife as recited in claim 1 further comprising a watertight capsule for storing survival paraphernalia.

6. A multipurpose knife for cutting, said knife comprising:

a handle;

means for cutting attached to said handle; and a flashlight having a substantially cylindrical body portion attachable to said handle to illuminate said cutting means, said flashlight being operable when detached from said handle, said flashlight being attached to said handle by a longitudinal slot formed on the exterior of said handle, said slot being sized to cooperatively engage a matching protruding rail formed on the exterior of said flashlight, said slot being positioned to allow said flashlight to illuminate said cutting means during attachment of said flashlight to said handle.

7. The knife as recited in claim 6 wherein said slot includes a locking means to securely retain said illuminating means in cooperative engagement with said handle.

8. A multipurpose knife comprising:

a body;

a knife blade pivotably attached to said body, said blade having an extended and folded position;

a substantially cylindrical recess formed in said body;

a self-contained flashlight at least partially contained by said recess, said flashlight being detachable from said body, said recess being formed to allow said flashlight to illuminate said knife blade when said knife blade is in said extended position and said flashlight is at least partially contained in said recess.

9. The knife as recited in claim 8 further comprising a means for preventing unintentional detachment of said flashlight from said body.

10. The knife as recited in claim 9 wherein said means for preventing unintentional detachment is a constriction in said recess, said constriction frictionally contacting said flashlight when said flashlight is at least partially contained in said recess.

11. The knife as recited in claim 8 further comprising a detachable compass.

12. The knife as recited in claim 8 further comprising a weighing scale.

13. The knife as recited in claim 8 further comprising a watertight capsule for storing survival paraphernalia.

* * * * *